US006108878A

United States Patent [19]

Adell

[11] Patent Number: 6,108,878

[45] Date of Patent: Aug. 29, 2000

[54] WIRE CONNECTION SYSTEM

[76] Inventor: Carrie Adell, P.O. Box 6924, Santa Fe, N. Mex. 87502

[21] Appl. No.: 08/998,516

[22] Filed: Dec. 26, 1997

[51] Int. Cl.[7] ..... A44B 9/12

[52] U.S. Cl. ..... 24/709.8; 24/707.6; 63/13; 63/29.1; 63/40; 403/396

[58] Field of Search ..... 63/12, 20, 23, 63/29.1, 40, 13; 403/384, 400, 396, 388, 389, 205; 24/71 J, 70 J, 116 A, 709.8, 707.6

[56] References Cited

U.S. PATENT DOCUMENTS

| | | | |
|---|---|---|---|
| 2,313,280 | 3/1943 | Szego | 52/665 |
| 5,411,516 | 5/1995 | Thomas | 63/12 X |
| 5,515,584 | 5/1996 | Adell | 24/709.8 |

*Primary Examiner*—Lynne H. Browne
*Assistant Examiner*—David E. Bochna
*Attorney, Agent, or Firm*—John Schipper

[57] ABSTRACT

A wire connection system that includes an arcuate wire and a pair of tube ends; or two or more wires, at least one wire being arcuate, and two or more pairs of tube ends. Each wire has a first wire end that fits into a first tube end and has a second wire end that fits into a second tube end, where two tube ends in a connected pair are either rigidly attached to each other or are partly free to rotate relative to each other. One or both tube ends in a connected pair has an interior including an annular region of easily compressible material, with an annular region aperture having an aperture diameter that is less than the diameter of the wire end accepted by the tube end. Alternatively, friction between at least one tube end and a temporarily deformed wire end received by the tube end holds the wire end in place. The system can serve as a pendant, an earring, a neckpiece, a bracelet or other decorative item for jewelry, beads, cards, placards or other appendages.

16 Claims, 3 Drawing Sheets

FIG. 1A
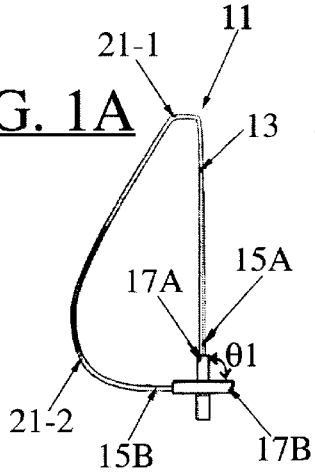
FIG. 1B
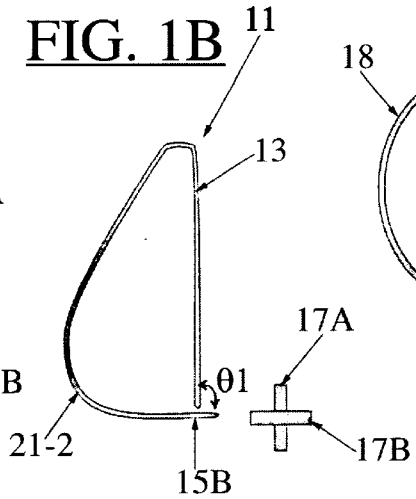
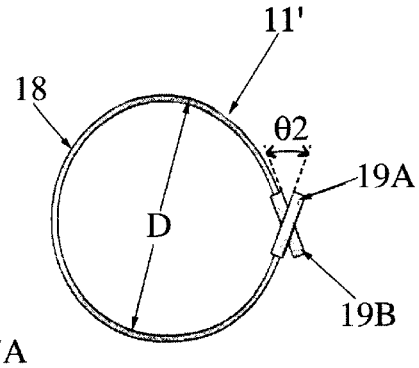
FIG. 1C
FIG. 7
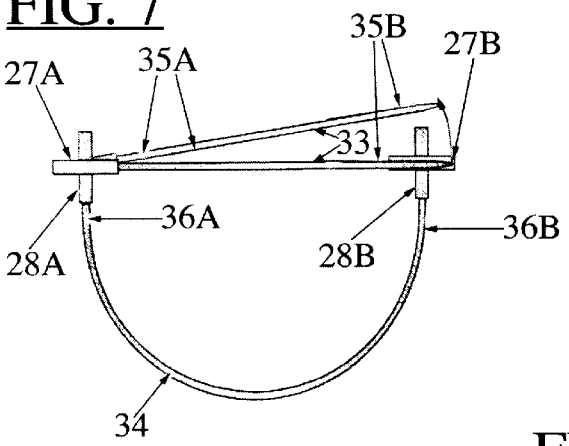
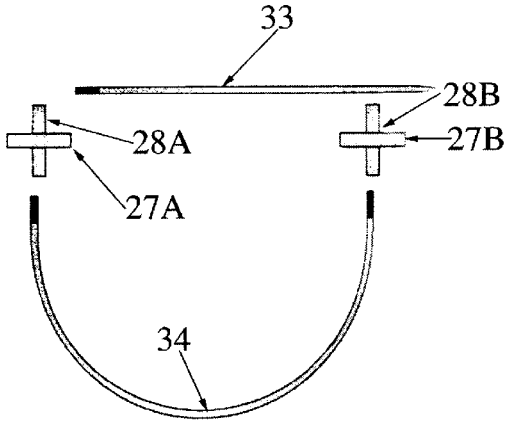
FIG. 1D
FIG. 6
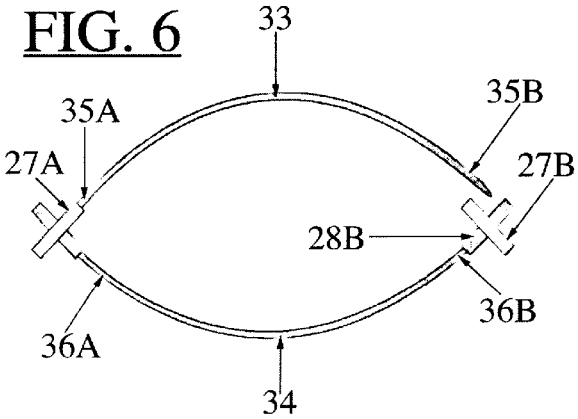
FIG. 8
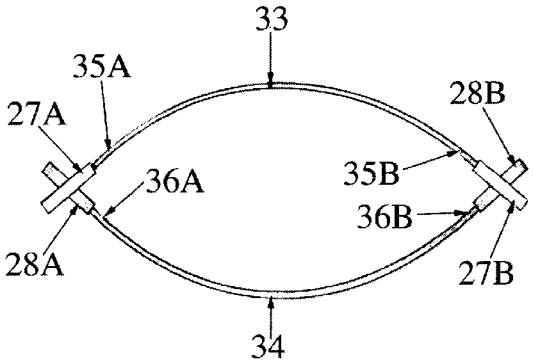

WIRE CONNECTION SYSTEM

FIELD OF THE INVENTION

This invention relates to jewelry "findings," which are mechanical components of jewelry that are assembled to make larger components.

BACKGROUND OF THE INVENTION

Beads, ornaments and other jewelry parts are being made and sold everywhere, by hobbyists and by professional craftspeople. These workers often produce their own beads, ornaments, gemstones and metal decorations, as well as enamels, glasses, clays, polymer clays, plastics and paper products. Beads are collected for historical and anthropological interests, as well as for their intrinsic, esthetic and artistic values.

To a jeweler with substantial experience and the proper tools, making a fastening system for mounting beads, ornaments and similar jewelry parts is straightforward. However, for the average jewelry hobbyist, the task of making a system for fastening and displaying these items may be beyond the experience, skill, equipment or time available to the hobbyist. Standard findings are available, but these often do not meet the requirements of the hobbyist and do not offer the creative latitude or the look of fine jewelry that a hobbyist may seek.

Several patents disclose wire fastening systems for beads, ornaments, pins, earrings and similar jewelry items. These include U.S. Pat. No. 148,390, issued to Tappan, No. 635, 249, issued to Hay, No. 741,024, issued to Von Frantzius, No. 1,515,313, issued to Pejchar, No. 2,275,984, issued to Nitchman, No. 2,287,865, issued to Carleton, No. 3,968, 357, issued to Hamilton, No, 4,041,946, issued to Barton, No. 4,276,757, issued to Boening, No. 4,694,664, issued to Elsener, and No. 5,031,420, issued to Song.

What is needed is an improved wire connection system for display of jewelry and other items that (1) is relatively light and non-obtrusive, (2) allows easy assembly and disassembly, (3) securely holds the jewelry items in place in its assembled form and (4) enhances, rather than competes with, the appeal of jewelry items, such as beads, ornaments, gemstones and the like, that are displayed using the wire connection system.

SUMMARY OF THE INVENTION

These needs are met by the invention, which provides a wire connection system including an arcuate wire and two end tubes for fastening, where an end tube may have an exposed interior surface including an annular region of easily compressible material with an annular region aperture that has a frictional reaction with a wire end that is positioned in the aperture. The two tube ends are oriented (rigidly or rotatably) relative to each other at a nonzero angle, preferably between 30° and 150°, and more preferably at an angle of about 90°. In one approach, an end tube includes an interior annular surface of rubber with a central aperture therein, and the end tube receives a first wire end that is preferably smooth and has either a blunt end or a pointed end. A second wire end is secured in the second tube end by threading, compression, or normal wall-to-wall friction enhanced by wire springiness that urges the wire end against the tube end inner surface, or in a manner similar to that used for the first tube end. The arcuate wire may be replaced by a first wire and a second wire, at least one being arcuate, where a first end of each of the first and second wires is received and releasably held by a first pair of tube ends and a second end of each of the first and second wires is received and releasably held by a second pair of tube ends.

The wire connection system can be used to create jewelry by allowing beads, ornaments and other similar jewelry items, each with an aperture therein, to be placed on the wire and secured by the two tube ends. In one approach, one or many jewelry items can be placed on the wire from either wire end. The user can thus position jewelry items on the wire from either end. Where the wire connection system and the displayed jewelry item(s) are to function as a brooch or pendant, the wire itself may be secured to fabric, such as an item of clothing.

BRIEF DESCRIPTION OF THE DRAWINGS

FIGS. 1A, 1B, 1C, 1D, 10A, 10B, 11A and 11B illustrate wire connection systems in various assembled states and disassembled states.

FIGS. 5A and 5B illustrate the invention in use and holding a plurality of beads, ornaments, gemstones and the like.

FIGS. 6, 7 and 8 illustrate uses of the invention using two wires rather than one wire.

DESCRIPTION OF BEST MODES OF THE INVENTION

FIGS. 1A and 1B show a wire connection system 11, fabricated according to the invention, in an assembled state and in a disassembled state, respectively. The wire connection system 11 includes a wire 13 having a first end 15A and a second end 15B, a first tube end 17A that receives and holds the first wire end 15A, and a second tube end 17B that receives the second wire end 15B. The wire 13 preferably has an arcuate shape, with a first arc 21-1 with associated bend angle (greater than 90° and no more than 180°) nearer to the first wire end 15A, and with a second arc 21-2 with associated bend angle (no greater than about 135°) nearer to the second wire end 15B. The second arc 21-2 is preferably more gradual and less pronounced than the first arc 21-1. Alternatively, the wire 13 may have an arbitrary arcuate shape as long as the first and second ends of the wire 13 are oriented at an angle of between 30° and 150° relative to each other.

The first tube end 17A and second tube end 17B are attached to each other, with respective first and second tube end axes that are oriented relative to each other at an angle θ1 that is preferably in an angle range of 30° to 150°. The attachment of the first and second tube ends 17A and 17B to each other need not be rigid: the first and second tube ends may be allowed to rotate relative to each other but are connected by a mechanical attachment, such as a (hidden) pin connecting the tube ends, that allows such rotation.

FIG. 1C shows a wire connection system 11', suitable for use as a hand or foot bracelet, neckpiece or similar decorative item, in assembled form. The system 11' includes an arcuate wire 18, formed approximately as a circle or oval, with first and second ends of the wire being received and held by first and second tubes 19A and 19B, respectively. The first and second tubes 19A and 19B are oriented relative to each other at an angle θ2 that is preferably in an angle range between 0° and 60°, but may extend to larger angles as well. The two tubes 19A and 19B may rotate relative to each other, using a mechanical attachment that allows such rotation, or may be held at a fixed angle θ2(fixed) relative to each other.

Figure 2:
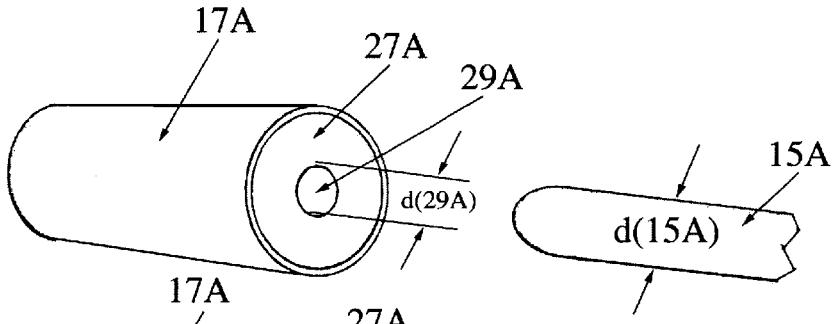
FIGS. 2, 3, 4 and 9 illustrate mating of a wire end and a tube end according to four embodiments of the invention.

In a first embodiment, illustrated in FIG. 2, at least one wire end, say, 15A, is blunt with a diameter d(15A); and the corresponding tube end 17A that receives the first wire end includes an annular region 27A of rubber, neoprene, flexible plastic or other easily compressible material. The annular region 27A has an approximately centrally located aperture 29A therein with a diameter d(29A) that preferably satisfies the constraint d(29A)≦d(15A) so that the wire end 15A must be forced into the aperture 29A. The first wire end 15A is received by the aperture 29A at the first tube end 17A, by compressing the compressible material surrounding the aperture 29A and forcing this aperture to expand to receive the first wire end 15A. The resistance to compression of the annular region 27A and the (modest) natural friction of the wire material and the annular sector material (which differ from each other) provide sufficient friction to hold the first wire end 15A in place, when the first wire end 15A is inserted into the first tube end aperture 29A.

Figure 3:
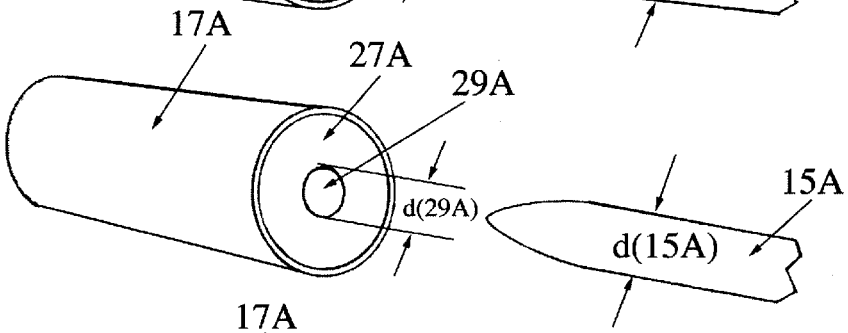

In a second embodiment, illustrated in FIG. 3, at least one wire end, say, 15A, is tapered or pointed with a diameter d(15A); and the corresponding tube end 17A that receives the first wire end again includes an annular region 27A of rubber or other compressible material. The annular region 27A has an approximately centrally located aperture 29A therein with a diameter d(29A) that preferably satisfies the constraint d(29A)≦d(15A). The first wire end 15A is received by the aperture 29A at the first tube end 17A, by compressing the compressible material surrounding the aperture 29A and forcing this aperture to expand to receive the first wire end 15A, as occurs in the embodiment shown in FIG. 2. Again, the resistance to compression of the annular region 27A and the (modest) natural friction of the wire material and the annular sector material (which differ from each other) provide sufficient friction to hold the first wire end 15A in place, when the first wire end 15A is inserted into the first tube end aperture 29A.

Figure 4:
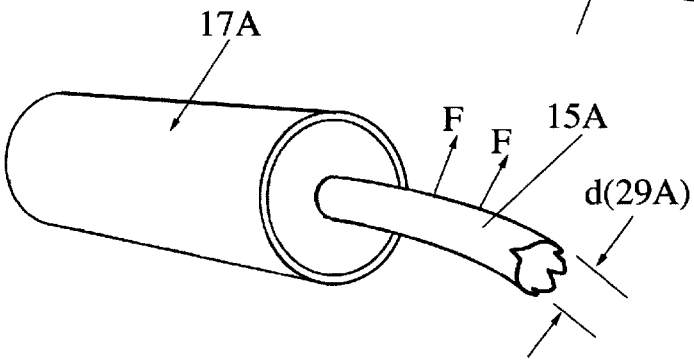

In a third embodiment, at least one wire end, say, 15A, is either blunt or pointed and is received by a corresponding tube end 17A, where a portion of the wire end is temporarily bent in an arcuate shape so that the natural springiness or deformation force F of the wire end urges the wire end against an inner surface of the tube end, as illustrated in FIG. 4. The friction that develops between the inner surface of the tube end 17A and the contiguous wire end 15A keeps the wire end within the tube end, and no other catch-and-hold mechanism is necessary here. In this embodiment, the diameter d(15A) of the wire end 15A can be any reasonable fraction (<1) of the inner diameter d(17A) of the tube end, but it is preferable that this fraction be fairly large.

In the first embodiment (FIG. 2) and in the second embodiment (FIG. 3), the second wire end 15B and the second tube end 17B may be constructed similarly to the first wire end 15A and the first tube end 17A shown in FIGS. 2 or 3. Alternatively, the second wire end 15B and the interior of the second tube end 17B may be threaded so that the second wire end and the second tube end are united or coupled by threading or screwing the second wire end into the second tube end, as illustrated in FIGS. 1*a* and 1*b* of U.S. Pat. No. 5,515,584, which is incorporated by reference herein.

Figure 5A:
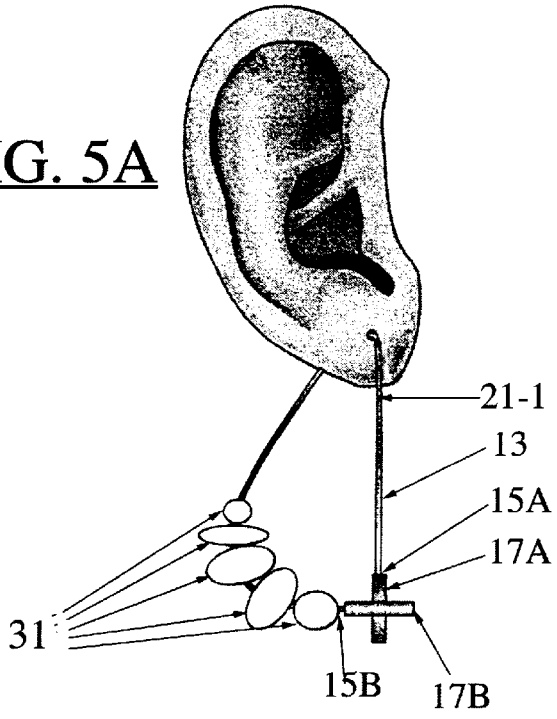
Figure 5B:
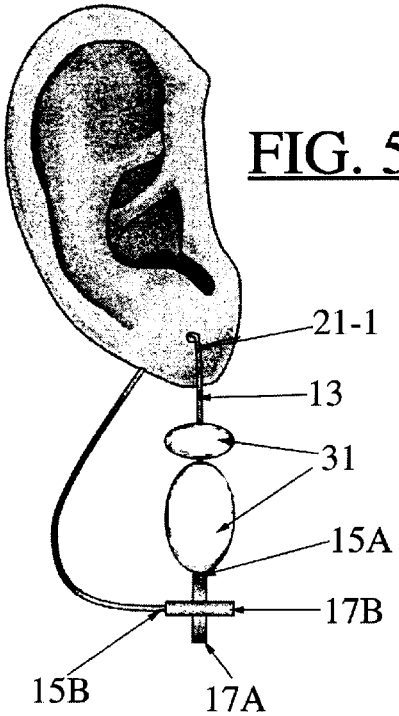

When the wire connection system 11 or 11' is worn as part of an earring, one end of the wire 13 is passed through a pierced ear lobe (aperture) and secured to the corresponding tube end, and the assembled wire connection system (FIG. 1A) is allowed to hang or dangle, with the weight of the wire connection system approximately resting on and hanging down from the first arc 21-1, as illustrated in FIGS. 5A and 5B. The wire connection system 11 can be disassembled, as shown in FIGS. 1B or 1D, and beads, ornaments, gemstones and the like 31 can be positioned on the wire 13 as shown. The wire 13 can then be passed through a pierced ear lobe, and the wire connection system can then be reassembled (FIG. 1A), as illustrated in FIGS. 5A and 5B.

When the wire connection system 11 or 11' is used as part of a pendant or brooch, beads, ornaments, gemstones and the like are positioned on the wire 13 as before, and the "open" end of the wire is passed through and hung from a fabric or article of clothing before the "open" end of the wire is reassembled to secure the beads or such on the wire connection system.

As noted earlier, the wire connection system 11' shown in FIG. 1C can be worn as part of a bracelet, neckpiece or similar decorative item. Here, decorative items such as charms, beads, stones and jewels can be slipped through an exposed wire end, and the assembled wire connection system can be positioned around a hand, foot or neck of the wearer. The diameter D of the wire connection system 11' can be made large enough that the assembled system can be slipped over a hand or over the head without disassembling the system. The wearer may prefer that the diameter D be made smaller so that the wire connection system must be disassembled, placed around a hand, foot or neck and reassembled, in order to preclude removal of the item without first disassembling the item.

FIGS. 6, 7 and 8 illustrate alternative approaches for using the invention to make a brooch or pendant or other clothing decoration. Less likely, the approaches shown in FIGS. 6, 7 and 8 can be used to make an earring or similar body decoration. In each of these three Figures, the single wire 13 of FIGS. 1A and 1B is replaced by a first wire 33 and a second wire 34, at least one wire each having a first wire end (35A and 36A) and a second wire end (35B and 36B). The first end 35A of the first wire 33 and the first end 36A of the second wire 34 are connected by first and second tube ends 27A and 28A; and the second end 35B of the first wire 33 and the second end 36B of the second wire 34 are connected by third and fourth tube ends 27B and 28B. The first and second tube ends 27A and 28A form a pair and the third and fourth tube ends 27B and 28B form a pair, and at least one tube end pair is preferably formed in the same manner as the tube end pair in FIG. 1A is formed. Each of the first and second wires can be arcuate, as shown in FIG. 6 and 8, or one wire 34 can be arcuate and the other wire 33 can be relatively straight, as shown in FIG. 7.

FIG. 1D illustrates one embodiment of the two-wire apparatus shown in FIGS. 6, 7 and 8, in a disassembled state. The apparatus includes the two wires 33 and 34, and the two tube end pairs 27A/28A and 27B/28B.

Figure 9:
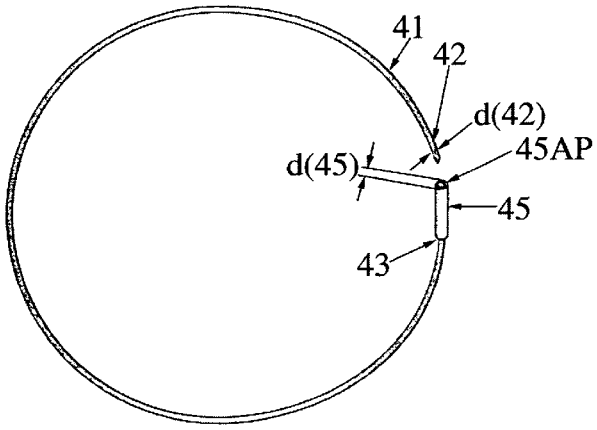

FIG. 9 illustrates another embodiment of the invention, using a single wire 41, formed in an ovular or circular shape, having a first wire end 42 with a wire diameter d(42) and having a second wire end 43 that is fitted with a wire-holding mechanism 45 that accepts and securely holds the first wire end. The first wire end 42 may be relatively blunt, as shown in FIG. 2, or may be relatively tapered, as shown in FIG. 3. The wire-holding mechanism 45 has an aperture 45Ap as shown. The aperture 45Ap may have a relatively small aperture diameter d(45) (<d(42)), may be partly filled with an elastomeric or compressible material, and may use friction to receive and hold the first wire end 42, as illustrated in FIGS. 2 and 3. Alternatively, the invention may use a first wire end diameter d(42) that is no larger than, and is preferably smaller than, the diameter d(45) of the wire-holding mechanism 45 and may use friction between the first wire end 42 and the interior wall of the aperture 45Ap in the wire-holding mechanism, as illustrated and discussed in connection with the embodiment shown in FIG. 4.

Figure 10A:
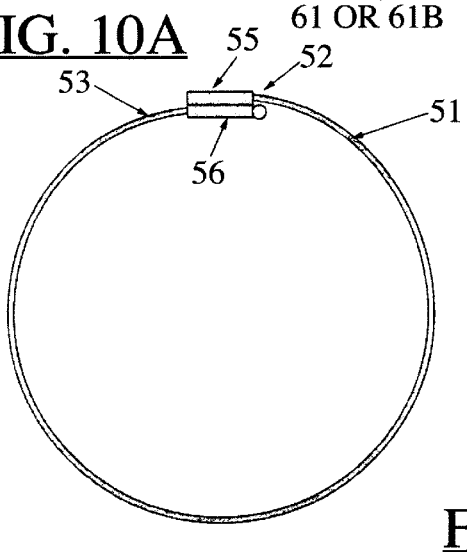
Figure 10B:
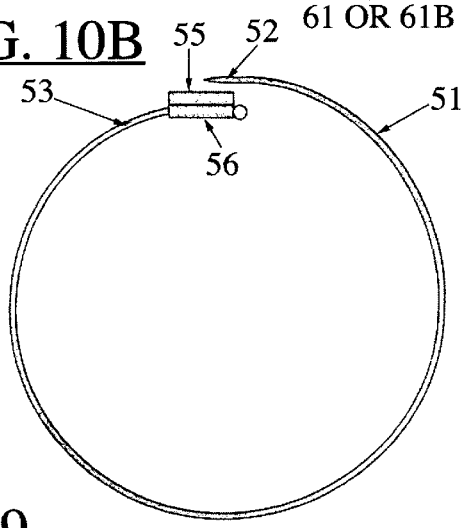

FIGS. 10A and 10B illustrate another embodiment of the invention in assembled and disassembled states, respectively. A wire 51, having a first wire end 52 and a second wire end 53, is formed in an ovular or circular shape, with the first wire end being relatively blunt or relatively tapered, as suggested in FIG. 10B. The first wire end 52 is received and held securely by a first wire-holding mechanism 55, using the compression approach illustrated in FIGS. 2 and 3, or using the friction approach illustrated in FIG. 4. The second wire end 53 is received and securely held by a second wire-holding mechanism 56, into which the second wire end is fitted as shown in FIGS. 10A and 10B. The second wire end 53 can be received and held by the second wire-holding mechanism 56, using the compression approach illustrated in FIGS. 2 and 3, using the friction approach illustrated in FIG. 4, or by threading the second wire end into a threaded aperture in the second wire-holding mechanism, as illustrated in FIGS. 1*a* and 1*b* of U.S. Pat. No. 5,515,584. Preferably, the first wire-holding mechanism 55 and the second wire-holding mechanism 56 are rigidly or rotationally attached to each other, as illustrated in FIG. 1C, discussed in the preceding.

Figure 11A:
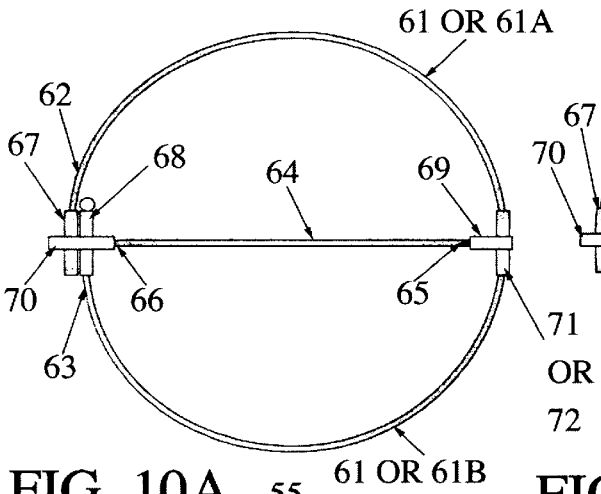
Figure 11B:
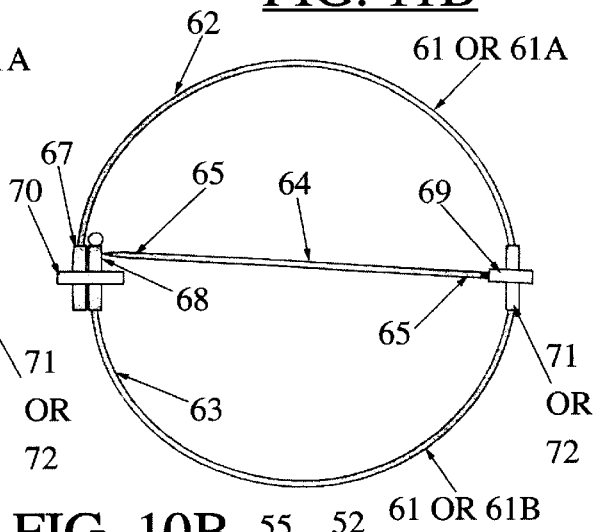

FIGS. 11A and 11B illustrate another embodiment of the invention in assembled and disassembled states, respectively. A first wire 61, having a first wire first end 62 and a first wire second end 63, is formed in an ovular or circular shape, with the first wire first end and the first wire second end being independently relatively blunt or relatively tapered or threaded. A second wire 64, having a second wire first end 65 and a second wire second end 66, is formed as a straight or mildly curved member, with the second wire second end being relatively blunt or relatively tapered, as suggested in FIG. 11B. The first wire first end 62 and the first wire second end 63 are received and held securely by a first wire-holding mechanism 67 and by a second wire-holding mechanism 68, respectively, using the compression approach illustrated in FIGS. 2 and 3, using the friction approach illustrated in FIG. 4, or using a threaded aperture as illustrated in FIGS. 1*a* and 1*b* of U.S. Pat. No. 5,515,584. The first and second wire-holding mechanisms 67 and 68 are rigidly or rotationally attached to each other, as illustrated in FIG. 1C. The second wire first end 65 is received and held by a third wire-holding mechanism 69, using the compression approach illustrated in FIGS. 2 and 3, using the friction approach illustrated in FIG. 4, or using a threaded aperture as illustrated in FIGS. 1*a* and 1*b* of U.S. Pat. No. 5,515,584. The second wire second end 66 is received and held by a fourth wire-holding mechanism 70, which is rigidly or rotationally attached to at least one of the first and second wire-holding mechanisms 67 and 68, using the compression approach illustrated in FIGS. 2 and 3, or using the friction approach illustrated in FIG. 4.

The third wire-holding mechanism 69 is rotationally attached to a wire conduit 71, through which the wire 61 passes, as illustrated in FIG. 11B. Alternatively, the wire conduit 71 may be replaced by a fifth wire-holding mechanism 72 and the first wire 61 may be replaced by a third wire 61A and a fourth wire 61B. In this alternative, one end of each of the third wire 61A and the fourth wire 61B is received and held securely by the fifth wire-holding mechanism 72 as shown, using the compression approach illustrated in FIGS. 2 and 3, using the friction approach illustrated in FIG. 4, or using a threaded aperture as illustrated in FIGS. 1*a* and 1*b* of U.S. Pat. No. 5,515,584.

In each of the embodiments illustrated in FIGS. 9, 10A, 10B, 11A and 11B, jewelry, beads, cards, placards or other suitable appendages may be hung or suspended from any or all of the wires 51, 61, 61A, 61B and 64, by "opening up" one end of the wire, slipping the desired appendage(s) onto the wire and "closing" that end of the wire again using the appropriate wire-holding mechanism.

The wire connection systems disclosed here are not limited to uses as jewelry display mechanisms but can be used for display of cards or small placards that present information in a text or graphics format. For example, a card having text or graphics information can be "hung" from an arcuate wire or straight wire and can serve as an identification card, to be worn around a wrist or the neck by a hospital patient or an attendee at a conference.

The embodiments of the invention shown and discussed herein are merely illustrative of modes of application of the invention. Reference to details in this discussion is not intended to limit the scope of the claims to these details, or to the figures used to illustrate the invention.

What is claimed is:

1. A wire connection system comprising:

an arcuate wire having a wire diameter, a first wire end and a second wire end, with at least the first wire end being unthreaded;

a first tube end to receive the first wire end within the first tube end; and a second tube end, connected to the first tube end, to receive the second wire end within the second tube end, wherein at least one of the first tube end and the second tube end is free to rotate relative to the other of the first tube end and the second tube end.

2. The system of claim 1, wherein said arcuate wire has an arcuate shape that is approximately an oval or circle.

3. The system of claim 1, wherein said first wire end is relatively blunt or is relatively tapered.

4. The system of claim 1, wherein at least one of said first tube end and said second tube end has an interior and includes an annular region including a material that is chosen from a class of compressible materials consisting of rubber, neoprene and flexible plastic.

5. The system of claim 1, wherein said second tube end has an interior that includes an annular region of compressible material with an annular region aperture having a diameter that is no greater than said wire diameter.

6. The system of claim 1, where at least one of said first tube end and said second tube end has an interior that includes an annular region of easily compressible material with an annular region inner diameter that is no greater than said wire diameter.

7. A wire connection system comprising:

a first arcuate wire having a first wire diameter, a first wire end and a second wire end, with the first and second wire ends being unthreaded;

a second arcuate or straight wire having a second wire diameter, a first wire end and a second wire end, with the first and second wire ends being unthreaded;

a first tube end, to receive the first wire first end within the first tube end;

a second tube end, to receive the first wire second end within the second tube end;

a third tube end, connected to the first tube end, to receive the second wire first end within the third tube end, where at least one of the first tube end and the third tube end is free to rotate relative to, the other of the first tube end and the third tube end; and a fourth tube end, connected to the second tube end, to receive the second wire second end within the fourth tube end.

8. The system of claim 7, wherein said second tube end and said fourth tube end are rigidly attached to each other.

9. The system of claim 7, wherein at least one of said first wire first end and said first wire second end is relatively blunt or is relatively tapered.

10. The system of claim 7, wherein at least one of said second tube end and said fourth tube end is free to rotate relative to the other of said second tube end and said fourth tube end.

11. The system of claim 7, wherein at least one of said first tube end and said second tube end has an interior and includes in the interior an annular region that includes a material that is chosen from a class of compressible materials consisting of rubber, neoprene and flexible plastic.

12. The system of claim 7, wherein at least one of said second tube end and said fourth tube end has an interior that includes a second annular region of a second easily compressible material with a second annular region aperture to receive a wire end having a diameter that is no greater than the diameter of the wire end received by the tube end.

13. The system of claim 7, where at least one of said first tube end, said second tube end, said third tube end and said fourth tube end has an interior that includes an annular region of an easily compressible material with an annular region inner diameter that is no greater than said diameter of said wire end to be received by the tube end.

14. A wire connection system comprising:

an arcuate wire having a wire diameter, a first wire end and a second wire end, with at least one of the first wire end and the second wire end being unthreaded;

a first tube end to receive the first wire end within the first tube end; and a second tube end, connected to the first tube end, to receive the second wire end within the second tube end, wherein at least one of the first tube end and the second tube end has an inner surface, the arcuate wire is deformed from an undeformed configuration in order that the first wire end can be received within the first tube end and the second wire end can be received within the second tube end, and at least one of the first wire end and the second wire end is urged against the inner surface of the at least one of the first tube end and the second tube end by a force that seeks to return the deformed wire to an undeformed configuration;

where at least one of the first tube end and the second tube end is free to rotate relative to the other of the first tube end and the second tube end.

15. A wire connection system comprising:

a first arcuate wire having a first wire diameter, a first wire end and a second wire end, with the first and second wire ends of the first wire being unthreaded;

a second arcuate or straight wire having a second wire diameter, a first wire end and a second wire end, with the first and second wire ends of the second wire being unthreaded;

a first tube end to receive the first wire first end within the first tube end;

a second tube end to receive the first wire second end within the second tube end, wherein at least one of the first tube end and the second tube end has an inner surface;

a third tube end, connected to the first tube end, to receive the second wire first end within the third tube end; and a fourth tube end, connected to the second tube end, to receive the second wire second end within the fourth tube end, wherein at least one of the third tube end and the fourth tube end has an inner surface;

where at least one of the first wire and the second wire is deformed from an undeformed configuration in order that the first wire end of the deformed wire can be received within the corresponding tube end and the second wire end of the deformed wire can be received within the corresponding tube end, and at least one of the first wire end and the second wire end of the deformed wire is urged against the corresponding tube end inner surface by a force that seeks to return the deformed wire to an undeformed configuration;

where at least one of the first tube end and the third tube end is free to rotate relative to the other of the first tube end and the third tube end.

16. A wire connection system comprising:

a first arcuate wire having a first wire diameter, a first wire end and a second wire end, with the first and second wire ends of the first wire being unthreaded;

a second arcuate or straight wire having a second wire diameter, a first wire end and a second wire end, with the first and second wire ends of the second wire being unthreaded;

a first tube end to receive the first wire first end within the first tube end;

a second tube end to receive the first wire second end within the second tube end, wherein at least one of the first tube end and the second tube end has an inner surface;

a third tube end, connected to the first tube end, to receive the second wire first end within the third tube end; and a fourth tube end, connected to the second tube end, to receive the second wire second end within the fourth tube end, wherein at least one of the third tube end and the fourth tube end has an inner surface;

where at least one of the first wire and the second wire is deformed from an undeformed configuration in order that the first wire end of the deformed wire can be received within the corresponding tube end and the second wire end of the deformed wire can be received within the corresponding tube end, and at least one of the first wire end and the second wire end of the deformed wire is urged against the corresponding tube end inner surface by a force that seeks to return the deformed wire to an undeformed configuration;

where at least one of the second tube end and the fourth tube end is free to rotate relative to the other of the second tube end and the fourth tube end.

* * * * *